US005332534A

United States Patent [19]

Ebner

[11] Patent Number: 5,332,534

[45] Date of Patent: Jul. 26, 1994

[54] PROCESS AND SYSTEM FOR INCREASING THE GAS UPTAKE BY A LIQUID BEING AERATED

[75] Inventor: Heinrich Ebner, Linz, Austria

[73] Assignee: Heinrich Frings GmbH & Co KG, Bonn, Fed. Rep. of Germany

[21] Appl. No.: 17,760

[22] Filed: Feb. 16, 1993

[30] Foreign Application Priority Data

Feb. 21, 1992 [AT] Austria ..... 325/92

[51] Int. Cl.[5] ..... B01F 3/04

[52] U.S. Cl. ..... 261/87; 261/120; 261/123

[58] Field of Search ..... 261/87, 120, 123, 93

[56] References Cited

U.S. PATENT DOCUMENTS

| | | | |
|---|---|---|---|
| 1,413,724 | 4/1922 | Groch | 261/87 |
| 1,441,560 | 1/1923 | Connors | 261/123 |
| 2,609,189 | 9/1952 | Dering | 261/87 |
| 2,892,543 | 6/1959 | Daman | 261/87 |
| 3,722,679 | 3/1973 | Logue | 261/87 |
| 3,775,307 | 11/1973 | McWhirter et al. | 261/87 |
| 3,794,303 | 2/1974 | Hirshon | 261/120 |
| 3,891,729 | 6/1975 | Ebner et al. | 261/87 |
| 4,070,423 | 1/1978 | Pierce | 261/120 |
| 4,268,398 | 5/1981 | Shuck et al. | 261/120 |
| 4,582,599 | 4/1986 | Repin et al. | 210/110 |

FOREIGN PATENT DOCUMENTS

| | | | |
|---|---|---|---|
| 392261 | 8/1990 | Austria . | |
| 0032235 | 7/1981 | European Pat. Off. . | |
| 2023981 | 11/1971 | Fed. Rep. of Germany | 261/87 |
| 0865845 | 9/1981 | U.S.S.R. | 261/120 |

*Primary Examiner*—Tim Miles

*Attorney, Agent, or Firm*—Norbert P. Holler

[57] ABSTRACT

A process and system for enhancing the oxygen uptake by a liquid being aerated in a basin or tank with the aid of an aerator which can only aerate the liquid over a cross-sectional zone smaller than the total floor surface of the basin or tank. To achieve the enhancement, there is provided vertically above the aerator but at the surface of the body of liquid an enclosure which is open at its top and bottom and has a cross-sectional size sufficient to surround approximately the entire region where the rising directly aerated quantity of liquid reaches the surface of the body liquid. The enclosure, which when installed has its top edge arranged above and its bottom edge below the surface of the body of liquid, is constructed and arranged to either entirely or partly inhibit flow of the upwardly displaced aerated liquid laterally outwardly from the region of its arrival at the surface of the body of liquid, thereby to control the "airlift effect" and the resultant liquid circulation which tends to reduce oxygen uptake.

18 Claims, 3 Drawing Sheets

PROCESS AND SYSTEM FOR INCREASING THE GAS UPTAKE BY A LIQUID BEING AERATED

This invention relates to aeration of liquids, and in particular to a process and system for increasing the uptake of gas by a liquid being aerated in an aeration basin or tank.

Although the present invention is of relatively wide utility and applicability, insofar as aeration of various types of liquids with various types of gases is concerned, it will be described in the first instance as applied to waste water purification. In this context, the following terminology, established by the American Society of Civil Engineers in 1984, will be used as deemed appropriate:

(a) The oxygen uptake, expressed in kg $O_2$/h, is denoted by the term "Standard Oxygen Transfer Rate" (SOTR).

(b) The oxygen yield, expressed in kg $O_2$/kWh, is denoted by the term "Standard Aeration Efficiency" (SAE).

(c) The oxygen consumption, expressed in %, is denoted by the term "Oxygen Transfer Efficiency" (OTE).

BACKGROUND OF THE INVENTION

For aerating waste water in basins or tanks, various different types of aeration systems can be used. Frequently, however, the aeration system employed is one by means of which the aeration is effected with a uniform distribution of the air bubbles in a region relatively close to the location of the aerator and in the immediate vicinity of the floor of the basin but not over the entire expanse of the basin floor. Such systems are, for example, ones which utilize pressurized aerators, jet nozzle aerators, immersion aerators, static mixers, and the like. In most cases where such an aerator is used, therefore, only a portion of the basin or tank is intensively aerated.

Merely by way of example, one type of immersion aerator which can be advantageously used in waste water aeration is disclosed in U.S. Pat. No. 3,891,729 and its progeny. Such an aerator includes, in essence, an immersion motor-driven rotor or turbine rotatable in the center of a guide ring, which turbine aspirates air automatically or under a minimal precompression and centrifuges it in a finely divided state and together with indrawn liquid approximately radially outwardly of the guide ring.

Since the generation of very fine air bubbles, which are a prerequisite for achieving a high SOTR when the level of the liquid in the basin is at a relatively low point, for example, at a height of between about 2 m and 4 m above the basin floor, is difficult to achieve by means of such aeration systems, the industry has frequently tried to avoid this problem by opting for large liquid heights, in which case, however, in order to avoid a too high energy consumption, the air must be fed into the aerator under a certain degree of precompression. The large liquid heights enable a better OTE to be achieved by virtue of the longer residence time of the rising air bubbles in the liquid, which in turn leads to a larger SOTR. It is, nevertheless, not always possible to install very deep aeration basins. Quite to the contrary, frequently it is feasible only to install aeration basins with a limited depth.

In this context, a peculiar phenomenon has been observed. On the one hand, an immersion aerator installed in a tank 3.8 m in diameter was tested under a liquid height of 4 m, and a very good SOTR characterized by an OTE of approximately 35% and an SAE of 2 kg $O_2$/kWh resulted. Thereafter, the same immersion aerator was tested in a waste water basin 10×10 m in size and at a liquid height of 4 m, and it was determined that the OTE dropped to about 20% and the SAE dropped to about 1.2 kg $O_2$/kWh. The initially inexplicable cause of this phenomenon became clear, however, after many tests.

The immersion aerator installed in the 3.8 m diameter tank was able to aerate the tank uniformly over its entire cross-section, but could not perform correspondingly in the large basin. Basically, each quantity of rising air performs work through its expansion, which work manifests itself in the elevation of a certain quantity of liquid. In the 3.8 m diameter tank, the elevated liquid level remains stationary, in other words, a balance is established between the constantly rising liquid and the liquid simultaneously descending between the air bubbles. The air bubbles rise approximately at a velocity of 0.2 m/s through a body of liquid 4 m high and thus have a residence time of approximately 20 seconds until they reach the surface of the liquid.

In the larger basin, which cannot be totally aerated, the relationships are fundamentally different. The air bubbles rise initially uniformly through a generally columnar region above the centrifugation zone of the submersible aerator, which region, depending on the size of the aerator, is approximately 4 m in diameter. The work generated by the expansion of the air bubbles, as previously mentioned, drives the liquid upwardly. As the level of the liquid above this region is elevated somewhat, the elevated liquid flows at first radially outwardly and then, after a certain outward flow, begins to flow back downwardly until, when near the floor of the basin, it flows back toward the center of the aeration region. As a result of this flow, the descending liquid throttles the air emission from the aerator. This causes the rising air, and with it the liquid, to be confined to a somewhat smaller cross-section, although the quantity of displaced liquid remains the same since it depends only on the work output of the rising quantity of air.

In such a case, the velocity of upward flow of the liquid attains values which lie between 0.2 and 0.5 m/s. The gas bubbles, however, rise about 0.2 m/s faster than the liquid and thus reach the upper surface of the liquid in a very short time, for example, within 6 to 10 seconds. That means that the residence time of the air bubbles in the liquid becomes as small as it would be if the height of the body of liquid in a small vessel would be only 1.2 to 2 m. As a result, the OTE and therewith the SOTR decreases correspondingly. The cause of this can thus be seen to reside in the liquid circulation which is created, which is also known as the "airlift effect".

BRIEF DESCRIPTION OF THE INVENTION

The principal objective of the present invention is, therefore, to provide means for and a method of enabling an equally good OTE to be achieved in a large basin as well as in a smaller tank, despite the fact that only parts of the large basin are uniformly intensively aerated.

In accordance with the basic principle of the present invention, this objective is achieved by virtue of the fact that the quantity of liquid which is displaced upwardly by the expansion work of the rising quantity of air is either completely or partly inhibited from flowing laterally outwardly from the columnar region of aeration at the intersection of that region with the surface of the body of liquid while waste air reaching the surface at that location escapes without restraint into the atmosphere, although, at a location spaced from and below the surface of the body of liquid, a laterally outwardly directed flow by a portion of the aerated liquid which has descended from the surface back to that location does take place.

In accordance with one aspect of the present invention, a particularly good mixing of the liquid in the outer region of a very large aeration basin may be achieved by permitting a part of the upwardly displaced quantity of liquid at or in the vicinity of the surface of the body of liquid to flow outwardly from the top of the columnar aeration region, and in accordance with a refinement of this aspect of the invention the outward flow may be aimed and preferentially directed in predetermined directions, for example, toward the corners of the basin.

In accordance with another aspect of the present invention, there is provided, for implementing the aforesaid process aspects of the invention, an arrangement for increasing the SOTR of the liquid by controlling the liquid circulation in a basin only a portion of which near the floor of the basin is intensively aerated. To this end, the arrangement is characterized by the provision of means in the form of an enclosure-forming structure which is located near the surface of the body of liquid being aerated and which either entirely or almost entirely confines therewithin the uppermost end zone of the columnar aeration region so as to at least partly and possibly even completely inhibit the lateral outflow of the portion of the aerated liquid, which has been upwardly displaced by the rising quantity of air, from the said end zone of the aeration region in which that risen portion of the liquid encounters the surface of the body of liquid while permitting the waste air reaching the surface at that location to escape without restraint into the atmosphere.

The enclosure, generally speaking, is constituted by one or more wall members providing the structure with vertical inside surfaces and defining an interior space which is open at its top and bottom and is located above, i.e., in alignment with, the intensively aerated zone surrounding the location of the aerator at the bottom of the basin, the cross-sectional size of the space being sufficient to accommodate approximately all of the top end section of the region of the liquid which is directly aerated by the mass of substantially vertically rising air bubbles. The cross-sectional shape of the enclosure and especially of the space defined thereby may be square, rectangular, polygonal, or round. In most practical systems, the spacing of the opposite vertical enclosure wall surfaces from one another (irrespective of whether these are planar surfaces bounding a multisided structure or sections of a single curved surface bounding a round, e.g., cylindrical, structure) will be between 2 and 10 m, preferably between 3 and 7 m, and the height of the enclosure between its open top and bottom ends advantageously will be between about 10% and 70% of the height of the body of liquid.

In accordance with one embodiment of the present invention, the enclosure is floatingly installed on the body of liquid, being held in its position by lateral anchoring devices. Alternatively, however, the enclosure structure can also be fixedly mounted in the basin at the desired elevation.

For the purposes of the present invention, it is contemplated that the enclosure in one version thereof will be so arranged, in terms of its height and the elevation of its top boundary edge above the level of the elevated liquid within the enclosure structure, that it will entirely inhibit any flow of the elevated aerated liquid from within the enclosure radially outwardly thereof over its top boundary edge. Rather, as the air bubbles, upon reaching the elevated surface of the liquid within the enclosure, escape without restraint into the atmosphere, the liquid will tend to descend again through the enclosure, countercurrent to any still rising liquid, and will then escape generally laterally from the columnar aeration region into the main body of liquid, thereby providing a degree of mixing by replacing some of the less aerated liquid as the latter is drawn downwardly toward the basin floor and into the rotor of the aerator. It is also contemplated, however, that the enclosure may be arranged either so as to permit some outward flow of the elevated liquid over all sections of the top edge of the enclosure, or that it may be provided, at or near its top boundary edge, with overflow recesses or openings permitting some outward flow of the intensively aerated liquid. In these latter cases, of course, the enclosure will only partially inhibit outward flow of aerated liquid from the top region of the enclosure. This can be advantageous, under certain operating conditions, for the complete mixing of the liquid in the basin.

In order, especially in the case of very large basins, to direct the outward top flow of the liquid preferentially into the corner regions of a square or rectangular basin for the purpose of enhancing the mixing action in those regions, the mentioned overflow recesses or openings of the wall members of the enclosure should, of course, be provided at locations facing the basin corners.

As an illustration of the magnitude of the liquid circulation engendered by the aeration, the following representative conditions might be considered. It is assumed that the aeration of a quantity of waste water in a basin $10\times10$ m in size is to be effected at 800 $m^3/h$, and that the height of the liquid is 4 m at a temperature of 15° C. Under those conditions, the expansion work performed by the rising quantity of air can be calculated as being 7.8 kW. With that amount of work, 3 $m^3/s$ of water can be elevated 0.26 m. The expansion work thus generates a very strong liquid circulation. When this quantity of liquid is caused to rise in a cylindrical enclosure 4.5 m in diameter, the rise velocity of the liquid can be shown to be 0.24 m/s. Since the air moves about 0.2 m/s faster, it rises at a speed of 0.44 m/s. The residence time of the air in the liquid thus drops to 9 seconds, whereas without the circulation the residence time would be 20 seconds. Through the minimizing or inhibiting of the liquid circulation by means of an enclosure according to the present invention it becomes possible, therefore, to adjust the residence time of the air bubbles within wide limits.

BRIEF DESCRIPTION OF THE DRAWINGS

The foregoing and other objects, characteristics and advantages of the present of invention will be more fully understood from the following detailed description thereof when read in conjunction with the accompanying drawings, in which.

DETAILED DESCRIPTION OF THE INVENTION

Figure 2:
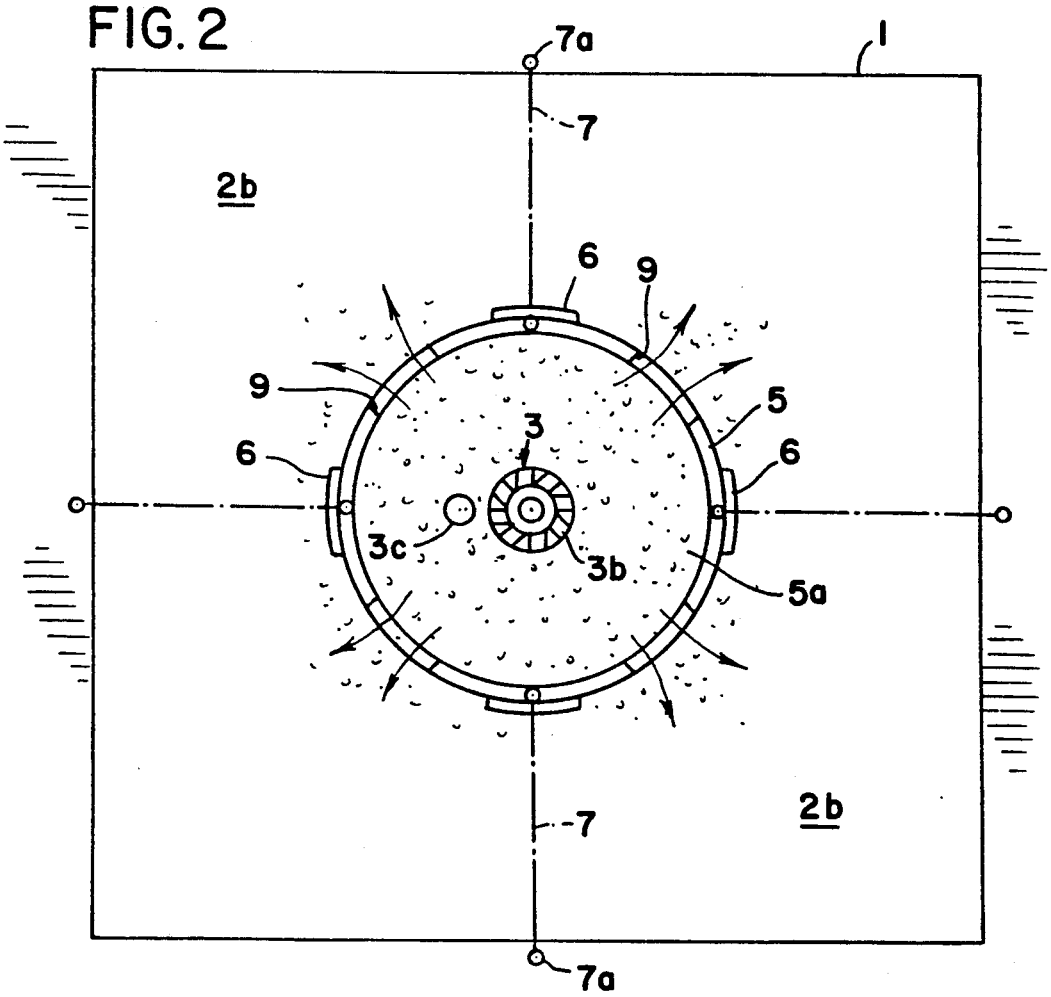
FIG. 2 is a top plan view the system shown in FIG. 1.

Referring now to the drawings in greater detail, FIG. shows a square waste water basin 1, the dimensions of which are 10×10 m, filled with water 2 to a height of 4 m. In the middle of the basin an immersion aerator 3 is located on the basin floor 4. The aerator 3, merely by way of example, is of the type disclosed in U.S. Pat. No. 3,891,729 (the relevant disclosures of which are incorporated herein by this reference) and includes a motor 3*a*, a vaned rotor (not shown) driven by the motor, a guide ring 3*b* (see also FIG. 2) surrounding the rotor, and an air aspirating pipe 3*c* extending upwardly out of the basin and communicating at its bottom end with the rotor via a connecting pipe 3*d*, the arrangement being such that when the motor 3*a* is running, air is aspirated through the pipes 3*c*/3*d* into the rotor which centrifuges it outwardly therefrom together with liquid through the guide ring 3*b*. In this manner, a 4 m wide generally columnar region 2*a* of the body of liquid 2 is directly and intensively aerated by the air centrifuged out of the aerator 3 and rising in the form of relatively small bubbles to the surface of the body of liquid through and within the columnar region 2*a* above the aerator.

As previously explained herein, were this aeration to proceed without any further refinement, the result would be that the region 2*b* of the body of liquid 2 surrounding the region 2*a* would be aerated either not at all or at best only minimally and insufficiently, and even in the aeration region 2*a* the SOTR would be relatively low. In accordance with the present invention, therefore, to minimize these problems there is located at the surface of the body of liquid over the immersion aerator 3 a cross-sectionally circular cylindrical hollow structure 5 which is open at the top and bottom, the circumferential boundary wall of which has a vertical interior surface enclosing a correspondingly configured space 5*a*, and the dimensions of which are an inner diameter of approximately 4 m and an axial height of approximately 1 m. The enclosure 5, the width of the interior space of which is about the same as (although it may be somewhat smaller than) the width of the aeration region 2*a*, is retained at the proper elevation by means of floats 6 suitably secured thereto at circumferentially spaced locations (the enclosure may, of course, be made of a buoyant material or constructed to be intrinsically floatable) so as to dispose the top boundary edge 5*b* of the enclosure a predetermined vertical distance above the level 2*c* of the main body of liquid 2 in the basin 1, and is restrained in its horizontal position by means of strands 7 (e.g., wires, ropes, cables, chains, etc., made of steel or reinforced plastics) anchored exteriorly of the basin at 7*a*. Alternatively, of course, the enclosure may be retained in its desired position by rigid supports such as, for example, an overhead bridge (not shown) or legs seated on the floor of the basin (not shown).

Figure 4:
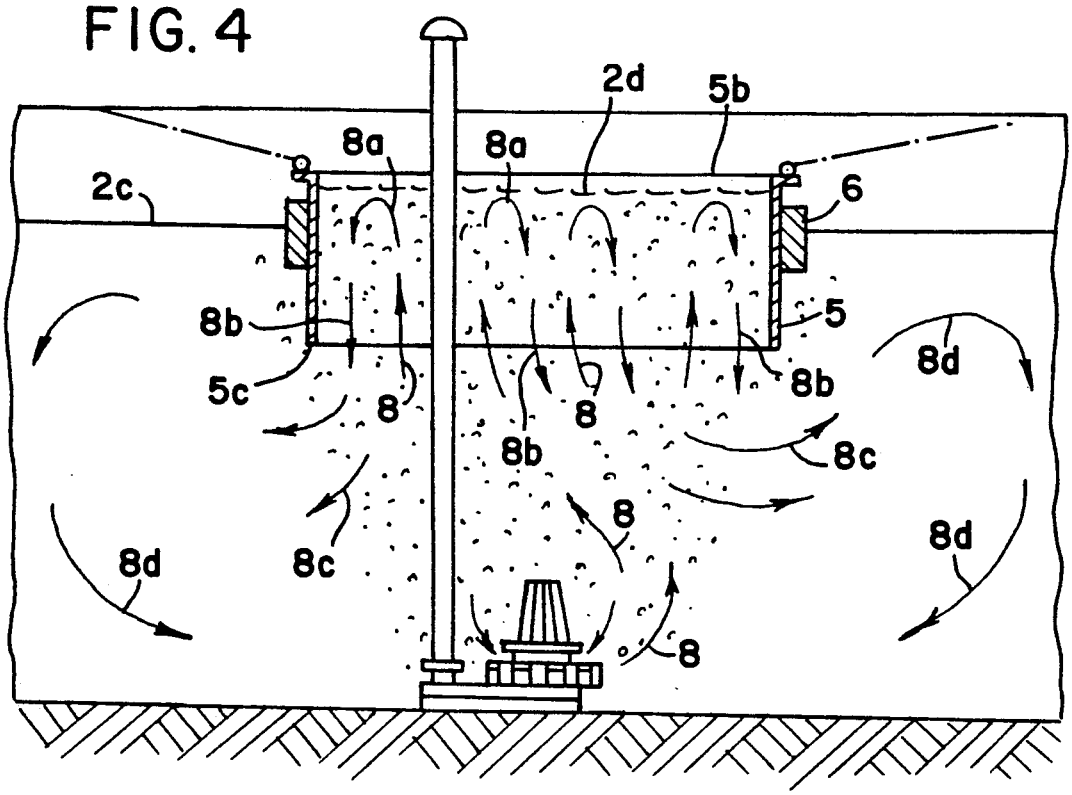

It will be apparent from the foregoing that the air bubbles emanating from the immersion aerator 3 rise from the latter generally vertically through the columnar aeration region 2*a*, as indicated by the arrows 8, so that most of the bubbles ultimately enter the space 5*a* within the enclosure 5. As previously mentioned, the air bubbles as they rise displace respective quantities of liquid upwardly, as a result of which the level 2*d* of the liquid interiorly of the enclosure 5 becomes elevated somewhat relative to the level 2*c* of the liquid surrounding the enclosure. By properly controlling the floating elevation of the enclosure, therefore, the condition can be reached, for example, where the wall of the structure 5 is entirely imperforate as shown in FIG. 4, that no liquid whatsoever flows radially outwardly from the interior of the enclosure 5 over the top edge 5*b* thereof into the surrounding regions of the basin. In this type of arrangement, the elevated liquid from which the air bubbles have escaped without restraint at the surface 2*d* will then reverse its course, as indicated by the arrows 8*a*, and flow downwardly through the enclosure 5 countercurrent to the rising air bubbles, as indicated by the arrows 8*b*. When the descending liquid passes the bottom boundary edge 5*c* of the enclosure 5, it will then flow laterally outwardly into the main body of liquid 2, as indicated by the arrows 8*c*, and will ultimately be circulated back to the aerator 3, as shown by the arrows 8*d*, so as to be again mixed with air bubbles and caused to rise through the aeration region 2*a*.

Figure 1:
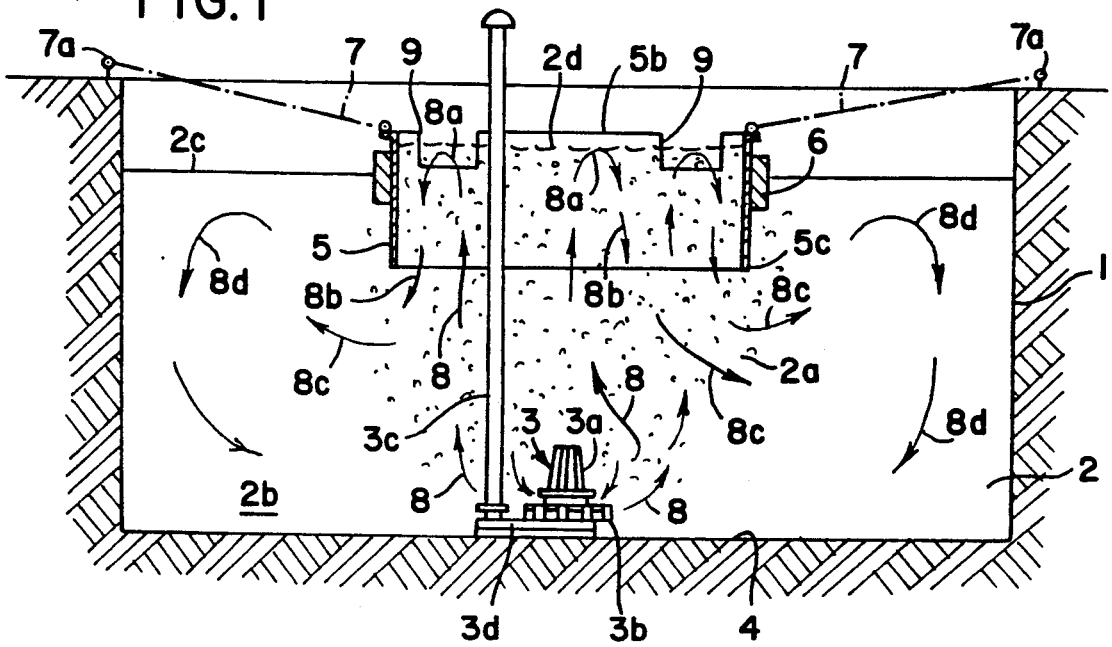
FIG. 1 is a vertical section through an aeration system including a square basin aerated by an immersion aerator and illustrates the use of a cylindrical enclosure structure having overflow recesses provided at its top edge.
Figure 3:
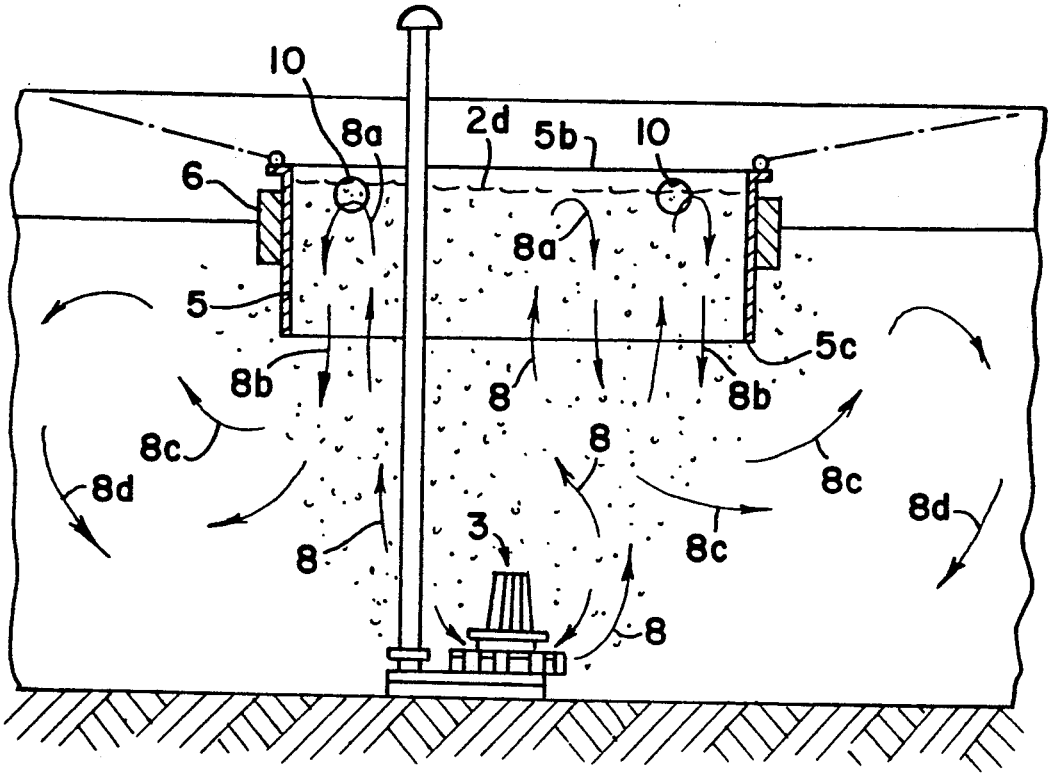
FIGS. 3 and 4 are sectional views similar to FIG. 1 but illustrate the use of cylindrical enclosures having, respectively, circular overflow openings provided below the top edge and no openings or recesses at all.

It will also be understood, of course, that in contrast to the arrangement shown in FIG. 4, a limited degree of radial flow outwardly from the top of the structure 5 may be desired under some circumstances. Provision for such limited overflow can be made on the one hand by appropriately lowering the rest position of the top edge of the enclosure, for example, through a higher affixation of the floats 6 to the enclosure (which would permit a flow over the entire top edge), and on the other hand by providing, for example, either a plurality of elongated upwardly open recesses 9 about 20 cm deep in the top boundary edge 5*b* of the enclosure 5 as shown in FIG. 1 or a plurality of through openings 10 about 15 cm in diameter in the wall of the enclosure 5 slightly below the top boundary edge 5*b* of the same as shown in FIG. 3. Also, by selecting specified locations of such recesses or openings on the enclosure 5, for example, as indicated for the recesses 9 in FIG. 2, it is possible to cause controlled quantities of the aerated liquid to flow radially out of the enclosure structure in predetermined directions, for example, along the diagonals of the basin and toward its corner regions, thereby to enhance the mixing action in those regions. In the latter of these variants, however, care must be taken that when the enclosure 5 is in its operational position and elevation relative to the liquid level 2*c*, the locus of the bottoms of the recesses 9 or the locus of the bottoms of the openings 10 will be at a level above the level 2*c*, so that no reverse flow of liquid from the main body of liquid in the basin into the enclosure can occur.

Figure 5:
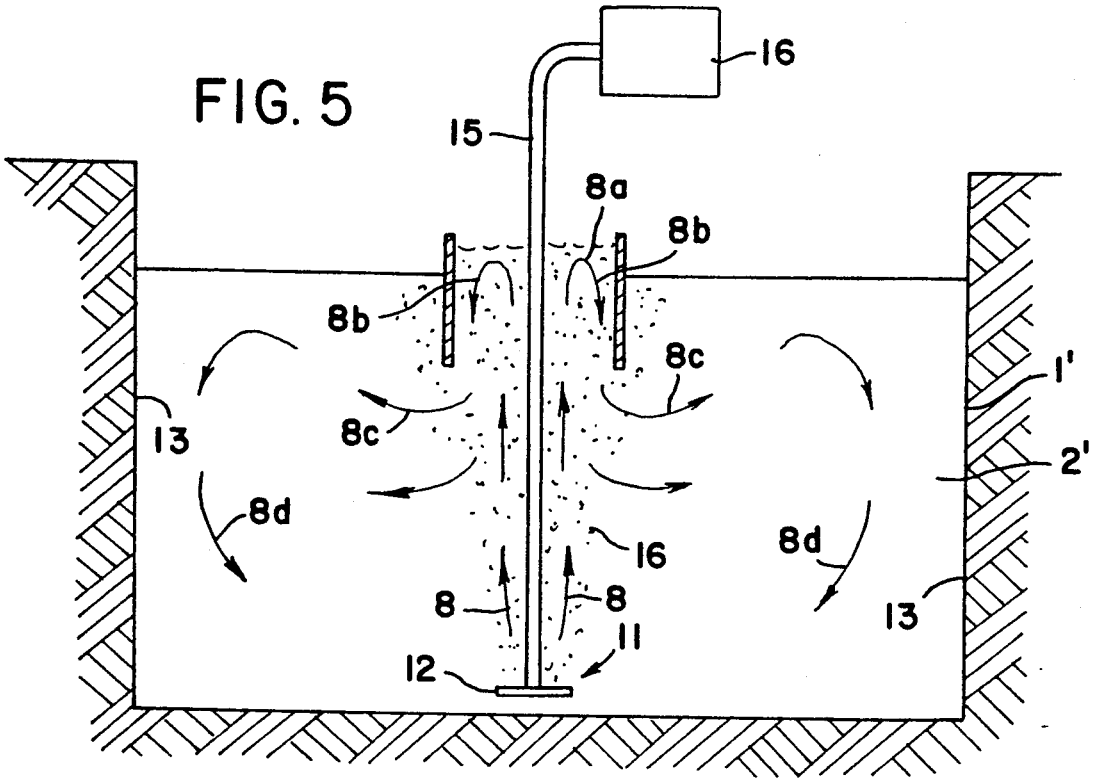
FIG. 5 is a vertical section through an aeration system including a square basin aerated by means of a pressure aerator and illustrates the use of a rectangular enclosure.
Figure 6:
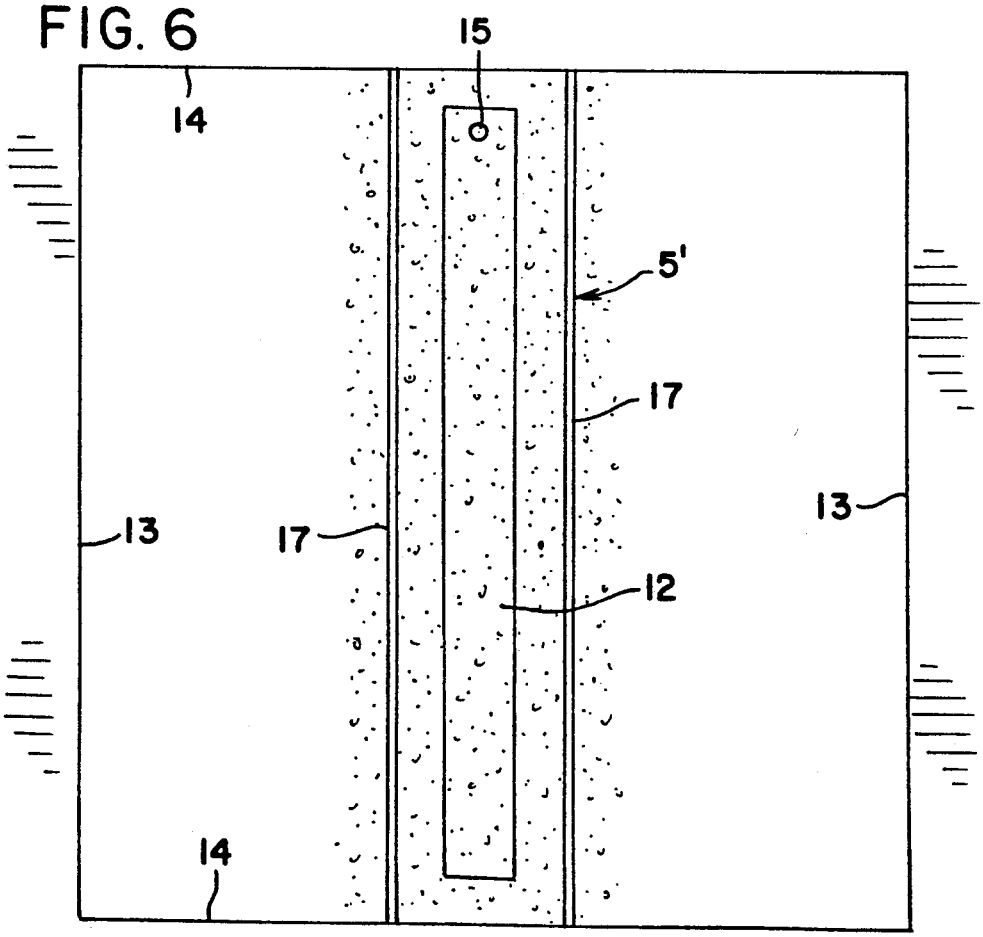
FIG. 6 is a top plan view of the system shown in FIG. 5.

In contrast to the aeration system shown in FIGS. 1 to 4, such a basin is frequently equipped with an aerating system which, as shown in FIGS. 5 and 6, makes use of an aerator 11 including an elongated strip- or plateshaped distributor member 12 of porous ceramic or a perforated or slitted synthetic plastic material, which member extends parallel to the side walls 13, 13 of the basin 1' and almost the full distance between the end walls 14, 14 of the basin, and a feed conduit 15 which communicates at one end thereof with the distributor member 12 at the bottom of the basin 1' and is connected at its other end above the surface of the liquid in the basin with a compressor or like source 16 of pressurized air. The excess pressure generated by the device 16 must, of course, be sufficient to overcome the depth of the body of liquid 2' plus the pressure losses encountered in the feed conduit 15 and the distributor member 12, i.e., on the order of magnitude of about 1.5 bar. Suitable pressure regulator devices (not shown) can be used in conjunction with the device 16 to control the quantity of air fed into the basin.

In this system, therefore, pressurized air is fed through the conduit 15 to the distributor member 12 and exits therefrom in the form of air bubbles traveling upwardly through the aeration region 16 above the distributor member, as indicated by the arrows 8. Ordinarily, such an aeration system results, by virtue of the airlift effect, in a liquid circulation flowing toward both side walls of the basin. In order to avoid that type of circulation, the present invention contemplates inhibiting this lateral flow through the provision of an enclosure-forming structure 5' constituted preferably by a rectangular arrangement of boundary walls having vertical interior surfaces. Merely by way of example, the enclosure 5' can be constituted by a pair of built-in vertical walls 17, 17 extending from the end walls 14 of the basin and parallel to the side walls 13 thereof, so that the end walls 14 provide the vertical boundary surfaces at the two ends of the enclosure. Alternatively, of course, the enclosure 5' may be constituted of four walls without making use of the end walls of the basin, with such a structure then being located in its desired position either by means of floats and anchoring means analogous to those shown in FIG. 4 or by means of an overhead bridge (not shown) or by any other suitable support arrangement.

By so confining the rising quantities of air and liquid in the aeration region 16, with the liquid flow reversing and then going laterally out of the enclosure below the latter as again indicated by the arrows 8*a*, 8*b*, 8*c* and 8*d*, the aforesaid lateral flow of aerated liquid can be inhibited, whereby the oxygen transfer efficiency is materially enhanced. Thus, through the inhibition of the airlift effect and the resultant control of the liquid circulation, it is possible to increase the rise time of the bubbles to such an extent that the OTE and therewith the SOTR are substantially increased while simultaneously a satisfactory mixing of the contents of the basin is ensured.

The present invention will be more fully comprehended from the following examples.

EXAMPLE 1

A basin 10×10 m in size is filled with water to a height of 4 m. In the center of the basin floor is disposed an immersion aerator of the type shown in FIGS. 1 to 4, which aspirates 750 $m^3/h$ of air and centrifuges it outwardly over a region approximately 4.5 m in diameter. At the surface of the body of water above the immersion aerator there is arranged a floating cylindrical enclosure 4.5 m in diameter and 1 m in height. The cylindrical enclosure is so arranged that no liquid can flow over its upper edge from the interior of the enclosure. The level of the liquid within the cylindrical enclosure is, by virtue of the liquid having been elevated by the rising air bubbles, approximately 20 cm higher than the level of the liquid in the basin around the enclosure. Through a prescribed measurement of the SOTR, for the purposes of which the respective electrodes are arranged in the not directly aerated portions of the basin, it is found that the SOTR is 53 kg $O_2/h$ and that the SAE is 1.98 kg $O_2/kWh$. The OTE is found to be 23.7%.

EXAMPLE 2

The test procedure of Example 1 is repeated with all conditions unchanged except that the cylindrical enclosure is entirely removed from the basin. The outwardly directed water circulation over the immersion aerator can be readily observed. The SOTR in this case is found to have decreased to 30 kg $O_2/h$, the SAE to 1.08 kg $O_2/kWh$, and the OTE to 13.4%.

EXAMPLE 3

A basin 10×10 m in size is filled with water to a height of 4 m, as in Example 1. However, the immersion aerator is set to aspirate and distribute only 350 $m^3/h$ of air. Of two test runs, one is performed with an imperforate cylindrical enclosure of the type shown in FIG. 4 but 2.46 m in diameter and 1 m in height positioned in the basin, while the other is performed with that cylindrical enclosure removed from the basin. The SOTR is found to be 18.2 kg $O_2/h$ in the presence of the enclosure and 14.0 kg $O_2/h$ in the absence of the enclosure.

EXAMPLE 4

The test procedure is again run as in Example 1, differing only in that the cylindrical enclosure is provided at its top boundary edge with four recesses or cut-outs each 1 m long and 20 cm deep, positioned to permit liquid to overflow from the interior of the enclosure in the direction of the corner regions of the basin. The height of the liquid level within the cylindrical enclosure is found to rise to 5 cm above the bottoms of the overflow recesses, which difference determines the overflow rate. In this run, the SOTR is found to be 44 kg $O_2/h$, the SAE 1.6 kg $O_2/kWh$, and the OTE 19.6%.

The examples illustrate that inhibiting the liquid circulation in the manner and by the means described exerts an unexpectedly strong influence on the OTE. The frequently praised and often intentionally utilized airlift effect is, in actuality, extraordinarily harmful insofar as the OTE and along therewith the SOTR and the SAE are concerned. Despite the considerable size of a 10×10 m basin, the inhibition of the airlift effect enables a good OTE to be achieved (by virtue of the fact that the OTE-reducing effect of the accelerated rising movement of the air bubbles is counteracted by the partial or complete inhibition of the laterally outward flow of liquid from the top of the aeration zone) and simultaneously serves to mix the aerated liquid in the rise region of the basin with the not directly aerated liquid in the region of the basin surrounding the rise zone. A directionally predetermined partial overflow of the aerated liquid from the enclosure in the rise zone is also found to be advantageous for certain purposes, especially in particularly large basins.

The present invention, as previously indicated, is not restricted to the aeration of waste water but rather is applicable to all gas/liquid reactors in which, by virtue of an aeration not uniformly distributed over the cross-section of the basin or container, liquid circulations engendered by the airlift effect arise with the result that they appreciably minimize the gas uptake by the liquid. Merely by way of example, the process and system may be used in introducing ozone into drinking water for sterilization purposes, in introducing carbon dioxide into basic liquids for purposes of neutralization, and in numerous other industrial processes such as, for example, the desulfurization of flue gases. It will also be understood that in any given situation the qualitative and quantitative results of the operation will depend on the sizes of the aerator and the enclosure relative to the size of the basin and to the mixing action to be achieved.

I claim:

1. A process for increasing, through a control of the liquid circulation in a liquid-containing aeration basin, the uptake of oxygen by the liquid, with the size of the basin and the air bubbles emission characteristics of the associated aerator being such that only a portion of the total cross-section of the basin near its floor is intensively aerated by the aerator; wherein the improvement comprises the steps of:

(a) permitting waste air reaching the surface of the body of liquid to escape without restraint from the latter into the atmosphere about the body of liquid; and (b) completely or partly inhibiting the quantity of liquid, (i) which is displaced upwardly in the basin through the expansion work of the rising quantity of the aerating air bubbles and (ii) which through such upward displacement accelerates the rising movement of the air bubbles so as to tend to shorten their residence time in the body of liquid and have the effect of reducing oxygen uptake, from flowing laterally outwardly from the region of its arrival at the surface of the body of liquid in the basin, so that by virtue of such inhibition of lateral outward flow of liquid the oxygen uptake-reducing effect is counteracted.

2. A process as claimed in claim 1, wherein a part of the upwardly displaced quantity of liquid near the surface of the body of liquid is caused to flow laterally outwardly from said region in predetermined directions.

3. A process as claimed in claim 2, wherein the basin is polygonal in shape, and said part of the upwardly displaced liquid is caused to flow preferentially toward the corners of the basin.

4. A system for increasing, through a control of the liquid circulation in a liquid-containing aeration basin, the uptake of oxygen into the liquid, wherein an aerator introduces air bubbles into the basin near the floor thereof, and the size of the basin and the air bubbles emission characteristics of the aerator are such that only a portion of the total cross-section of the basin near its floor is intensively aerated; wherein the improvement comprises:

(a) means arranged at the surface of the body of liquid in the basin for completely or partly inhibiting the quantity of liquid, (i) which is displaced upwardly in the basin through the expansion work of the rising quantity of air bubbles and (ii) which through such upward displacement accelerates the rising movement of the air bubbles so as to tend to shorten their residence time in the body of liquid and have the effect of reducing oxygen uptake, from flowing laterally outwardly from the region of its arrival at the surface of the body of liquid in the basin, so that by virtue of such inhibition of lateral outward flow of liquid the oxygen uptake-reducing effect is counteracted; and (b) said inhibiting means being constructed and arranged to permit waste air reaching the surface of the body of liquid to escape without restraint from the latter into the atmosphere above the body of liquid.

5. A system as claimed in claim 4, wherein said inhibiting means comprise vertically arranged walls which define a square, rectangular or polygonal enclosure open at the top and bottom, and means are provided for supporting the enclosure in the basin at a location above the zone of intensive aeration.

6. A system as claimed in claim 5, wherein the basin has a plurality of walls, and said inhibiting means comprise two wall members arranged in said basin parallel to each other between two of said basin walls, each of said wall members being affixed at its opposite ends to said two walls of the basin, said wall members having their confronting surfaces disposed vertically and with the portions of said two basin walls between them constituting said enclosure, and the cross-sectional size of said enclosure being such that approximately the entire region of directly aerated liquid near the surface of the body of liquid is confined within said enclosure.

7. A system as claimed in claim 4, wherein said inhibiting means comprise wall sections with arcuate vertical surfaces which together define a cylindrical enclosure open at the top and bottom, and means are provided for supporting said enclosure in the basin at a location above the zone of intensive aeration, the cross-sectional size of the enclosure being such that approximately the entire region of directly aerated liquid near the surface of the body of liquid is confined within said enclosure.

8. A system as claimed in claim 7, wherein the cross-sectional size of the enclosure is between 2 and 10 m.

9. A system as claimed in claim 7, wherein the cross-sectional size of the enclosure is between 3 and 7 m.

10. A system as claimed in claims 5, 6, 7, 8, or 9, wherein the height of the enclosure between its top and bottom is between 10% and 70% of the height of the body of liquid in the basin.

11. A system as claimed in claims 5 or 7, wherein said supporting means comprise floats connected to said enclosure for enabling the latter to be floatingly supported by the body of liquid at the surface thereof, and lateral anchoring means for retaining said enclosure in its selected position.

12. A system as claimed in claims 5 or 7, wherein means are provided for fixedly anchoring the enclosure in the basin.

13. A system as claimed in claims 5 or 7, wherein said enclosure is arranged at such an elevation that no liquid displaced thereinto by the air can escape over the top edge of the enclosure from the interior of the latter to the exterior thereat.

14. A system as claimed in claims 5 or 7, wherein said enclosure is arranged at such an elevation that a portion of the liquid displaced thereinto by the air can overflow the top edge of the enclosure from the interior of the latter to the exterior thereof.

15. A system as claimed in claim 14, wherein said enclosure is provided with recesses in the top edge of the enclosure to permit the overflow and to control the quantity of liquid flowing out of the enclosure.

16. A system as claimed in claim 15, wherein said recesses are provided only in selected parts of the top edge of said enclosure to direct the overflowing quantity of liquid in predetermined directions away from the enclosure.

17. A system as claimed in claim 14, wherein said enclosure is provided with outflow openings below the top edge of the enclosure and at least partly below the elevated level of the liquid within the enclosure to control the quantity of liquid flowing out of the enclosure.

18. A system as claimed in claim 17, wherein said openings are provided only in selected parts of said enclosure to direct the outflowing quantity of liquid in predetermined directions away from the enclosure.

* * * * *